US005361807A

United States Patent [19]

Giovenzana

[11] Patent Number: 5,361,807

[45] Date of Patent: Nov. 8, 1994

[54] TRAVELING BLOWER TYPE CLEANING DEVICE FOR JACQUARD HARNESSES

[75] Inventor: Marco Giovenzana, Milan, Italy

[73] Assignee: Startes Jacquard S.r.l., Italy

[21] Appl. No.: 141,984

[22] Filed: Oct. 28, 1993

[30] Foreign Application Priority Data

Nov. 4, 1992 [IT] Italy ..... 002524 A/92

[51] Int. Cl.[5] ..... D03J 1/00

[52] U.S. Cl. ..... 139/1 C; 15/312.1

[58] Field of Search ..... 15/312.1; 139/1 C

[56] References Cited

U.S. PATENT DOCUMENTS

| | | | |
|---|---|---|---|
| 3,251,175 | 5/1966 | Black | 15/312.1 X |
| 3,491,801 | 1/1970 | Lipponer | 139/1 C X |
| 4,265,278 | 5/1981 | Jassniker | 139/1 C |
| 4,570,682 | 2/1986 | Bachmann | 139/1 C |
| 4,895,186 | 1/1990 | Shaw | 15/312.1 X |

FOREIGN PATENT DOCUMENTS

| | | | |
|---|---|---|---|
| 2487867 | 2/1982 | France | 139/1 C |
| 12902 | of 1912 | United Kingdom | 15/312.1 |

*Primary Examiner*—Andrew M. Falik

*Attorney, Agent, or Firm*—Shlesinger, Fitzsimmons & Shlesinger

[57] ABSTRACT

The harness cords of a Jacquard loom are connected at their lower ends by elongate return springs to a stationary support, which is mounted on the base of the loom. Mounted on the base of the loom beneath the support for reciprocation between opposite sides of the loom is a nozzle which is connected at one end to a supply of compressed air and has at its opposite, upper end an arcuate slot from which a stream of air is directed upwardly toward the lower ends of the return springs in a plane extending parallel to the harness cords, but transversely in the direction of movement of the nozzle, thereby to blow away lint which otherwise would collect adjacent the lower ends of the return springs.

6 Claims, 1 Drawing Sheet

TRAVELING BLOWER TYPE CLEANING DEVICE FOR JACQUARD HARNESSES

FIELD AND BACKGROUND OF THE INVENTION

In the field of looms of the so-called "Jacquard" type, it is well known that there is a problem connected with the deposit of dust onto the loom base, and in particular the deposit of such dust close to the harness cord return springs or elastic elements. In fact environment dust and the powders and downs produced by the fibers being worked descend along the harness cords and are deposited upon the base of the loom adjacent the return springs, thus interferring with the correct raising and lowering movements of the harness cords and their springs or lowering elements and therefore the warp threads. In order to avoid the loom jamming, a periodic cleaning is necessary, which cleaning is somewhat complicated taking also into account the fragility of the area to be cleaned. In addition, in case of looms having return springs on the harness, the reciprocating extension movement of the springs causes dust to be compacted therebetween forming at each spring a pad that first slows down the return function of the springs and finally inhibits their operation. Removal of these dust pads is a long and delicate operation imposing high and often unacceptable down times. In order to obviate the above problems, in the known art compressed air devices have been proposed which are generally embodied as carriages sliding sideways of the harness so as to direct air jets against said harness, perpendicularly to the cord extension. The side positioning of the jets has been universally chosen due to the belief that the air jets transversely passing through the harness cords should be capable of blowing dust away towards the outside, thereby preventing it from accumulating at the loom base.

Although this cleaning method is somewhat efficient, it suffers from a great number of drawbacks. In fact, the air jet pushes dust transversely through the thick and dense barrier consisting of the great number of parallel springs which substantially act as a sieve, thereby trapping a certain amount of dust in the innermost harness portion. In addition, due to the resistance offered by the springs or elastic elements to be passed through, the efficiency of the air jet decreases as said jet penetrates into the return elements. As a result, an important lack of homogeneity occurs in the cleaning action, so that cleaning is excellent in the lowering elements closer to the compressed air delivery nozzles, but is greatly insufficient in the farthermost elements which not only are not conveniently cleaned from the dust coming from top, but are also impinged on by the dust entrained by the air blow.

In the known art attempts have been made to obviate the above problem by increasing the power of the air jets, and actually cleaning in general is improved. However an undesirable side effect has been found in this case, i.e. bending of the lowering elements in the harness submitted to the air pressure occurs, which bending impairs the perfect operation of the loom. Attempts have been also made to create systems having more diffuse air streams for example by means of perforated ducts or chambers into which air is blown. Said air coming out of the holes then impinges on all the return elements. However these systems have a great air consumption and low efficiency.

SUMMARY OF THE INVENTION

The general object of the present invention is to obviate the above drawbacks, by providing a cleaning device enabling an efficient and uniform cleaning without impairing or hindering the loom operation.

In order to achieve the above object, in accordance with the invention a cleaning device for a loom has been provided which comprises a nozzle sliding by traverse means along the base of the loom frame and connected to a compressed air source so as to emit an air blow directed to the return elements of the harness for carrying out cleaning of same, wherein said nozzle is located under the lower terminal end of the return elements and is directed upwardly so that blowing takes place in a direction the axis of which is substantially parallel to the extension of the return elements close to said terminal end.

BRIEF DESCRIPTION OF THE DRAWINGS

For better explaining the innovatory principles of the present invention and the advantages it offers as compared to the known art, a possible embodiment of the invention putting said principles into practice will be given hereinafter by way of non-limiting example with the aid of the accompanying drawings, in which.

DESCRIPTION OF THE PREFERRED EMBODIMENT

Figure 2:
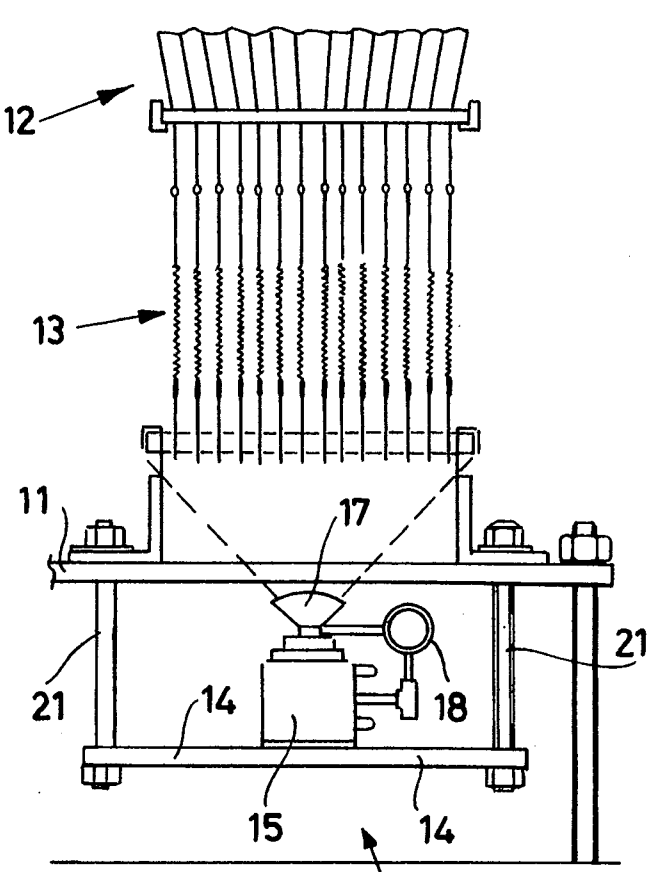
FIG. 2 is a side view of the device shown in FIG. 1.

Referring to the drawings, a cleaning device in accordance with the invention is generally identified by reference numeral 10. Said cleaning device is applied to the return area of the harness in a "Jacquard" loom. "Jacquard" looms are well known in the art and therefore they are not herein shown or described in detail. In particular, the device 10 is located under a fastening support 11 for an array of harness cords 12 of the loom, which cords are for example provided with known return springs 13 the upper ends of springs 13 being connected to the lower ends of the harness cords, and the lower ends of the springs being secured to the support 11.

As also well shown in FIG. 2, the device 10 comprises shelves 14 suspended by means of tie-rods 21 under the support 11 for fastening of the return elements. Resting on the shelves is a linear actuator 15 arranged so as to embrace the harness width and designed to move along said harness a carriage 16 supporting a nozzle 17 which connected, via a flexible spiral duct 18, to a shutoff valve supplied with compressed air from a source 20. The nozzle is directed upwardly and is of triangular shape exhibiting an enlarged opening in the form of a semicircular slit disposed transversely of the harness extension in order to produce an air sheet, when compressed air is supplied, in a plane lying transverse to the movement direction of the carriage 16 and thoroughly embracing the harness thickness, as shown in FIG. 2 in chain line.

Advantageously, the actuator 15 is a pneumatic actuator of known type, for example having a floating piston 22 connected to the carriage 16 by known systems (for example magnetic systems or systems having a support passing through the cylinder body at slits provided with sealing plates, etc.).

Figure 1:
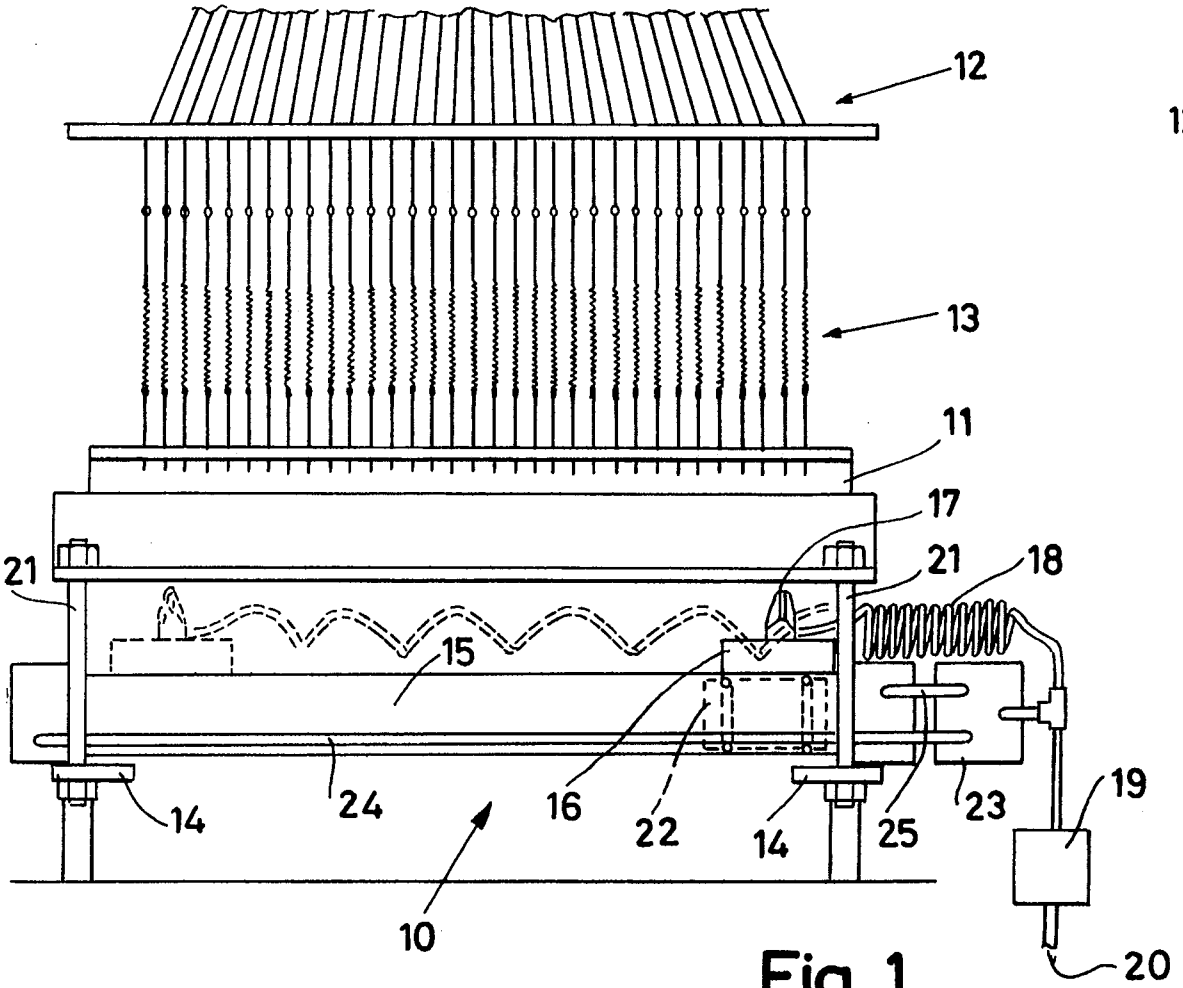
FIG. 1 is a diagrammatic front view of the lower portion of the harness of a loom incorporating the innovatory device herein claimed.

The actuator 15 of the double acting type., has end portions connected to the compressed air source through a known movement-reversing device or automatic switch valve 23. The valve 23 selectively sends air to one of the two end portions of the actuator 15 via ducts 24 and 25, in order to push carriage 16 to the opposite direction. When the piston reaches one end portion, overpressure due to the movement stopping causes the valve 23 to be switched over so that it stops supplying air to the first end portion and starts supplying it to the second end portion causing the carriage to come back, and so forth. In this manner, as far as the shutoff valve is open, the carriage 16 automatically goes on moving between the two end positions shown in solid line and chain line respectively in FIG. 1. At the same time the air sheet coming out of the nozzle 17 carries out a sweeping movement along the harness.

The use of a pneumatic actuator enables the emission of air from the nozzle and the displacement of the nozzle itself along the loom to be both controlled through operation of a single valve 19. The valve may be any known solenoid-actuated valve provided with a control timing device so that it opens for a predetermined period of time at predetermined intervals in order to carry out periodic cleaning operations. For example, a twenty seconds' opening time every fifteen minutes may be established. Obviously the valve may be located far away from the loom and in the case of a circuit with a pneumatic actuator as shown in the drawings, the presence of any electric device in the return area is avoided, which will eliminate all risks of fire, taking into account the high inflammability of the downs falling down from the loom.

At this point it is apparent that the intended purposes have been achieved, by providing a cleaning device that does not alter the arrangement of the harness cords in a loom, the air blow being substantially parallel thereto. It has been surprisingly found that, in spite of that which one could think, if air is blown from bottom to top by a single movable jet, a perfect cleaning is achieved, all dust being efficiently moved away. In fact, dust which is raised in this manner along the cords, does not fall again to the cord base but it is pushed to the outside of the harness following paths diverging from the line parallel to the cord assembly, due to the vortices that are created around the cords. It is also to be noted that blowing is parallel to the springs that therefore are carefully cleaned even within their coils.

Contrary to the known art, in which a plurality of nozzles is provided which are located at different heights on the harness side, by the present device a single nozzle is sufficient for cleaning the return area over the whole height thereof. In addition, a great amount of air is saved.

Obviously the above description is for purposes of illustration only and is not to be interpreted in a limiting sense. For example, the device dimensions and the system for fastening it to the loom depend on the actual loom structure.

In case of looms with harness of great thickness, two nozzles may be provided which are disposed in side by side relation in a direction transverse to their movement along the loom.

What is claimed is:

1. In a Jacquard loom of the type having a base, a harness cord support mounted on and extending between apposite sides of said base, an array of harness cords extending above said support, and a plurality of elongate harness cord return elements attached at their upper ends to said harness cords and at their lower ends to said support, the improvement comprising a nozzle slidable by traverse means along the base of the loom between opposite sides thereof, and being connected to a compressed air source for emitting a stream of air toward the harness cord return elements in order to carry out the cleaning of same, wherein said traverse means is positioned below said harness cord support whereby said nozzle is located under the lower ends of the return elements and is directed upwardly so that said stream of air is directed substantially parallel to the return elements adjacent said lower ends thereof.

2. The device as claimed in claim 1, wherein the nozzle is of substantially triangular form, and has an enlarged outlet end provided with a slit disposed transversely of the lengths of said return elements so as to produce an air sheet directed in a plane transverse to the direction of movement of said nozzle.

3. The device as claimed in claim 1, wherein the traverse means comprises a pneumatic linear actuator disposed transversely of the base of the loom and carrying a slidable carriage supporting the nozzle.

4. The device as claimed in claim 3, wherein the pneumatic linear actuator consists of a double-acting piston supplied with air at the two ends thereof by means of an automatic movement-reversing overpressure valve the inlet of which is connected to a compressed air source.

5. The device as claimed in claim 4, wherein the nozzle and movement-reversing valve are connected to the same compressed air source, a shutoff valve being interposed between said nozzle and valve and the compressed air source, so that on opening of the shutoff valve the nozzle emits a stream of air and at the same time the piston causes the automatic reciprocating motion of said nozzle.

6. The device as claimed in claim 5, wherein the shutoff valve comprises a timed control device for causing opening of the valve for a predetermined period of time at predetermined intervals so that the loom is submitted to periodic cleaning operations.

* * * * *